US009591710B1

(12) United States Patent
Zheng et al.

(10) Patent No.: US 9,591,710 B1
(45) Date of Patent: Mar. 7, 2017

(54) KIND OF LED PHASE CUT DIMMING POWER SUPPLY

(71) Applicant: Zhuhai Shengchang Electronics Co., Ltd., Zhuhai (CN)

(72) Inventors: Dehua Zheng, Zhuhai (CN); Xianyun Zhao, Zhuhai (CN)

(73) Assignee: ZHUHAI SHENGCHANG ELECTRONICS CO., LTD., Zhuhai (CN)

( * ) Notice: Subject to any disclaimer, the term of this patent is extended or adjusted under 35 U.S.C. 154(b) by 0 days.

(21) Appl. No.: 15/247,936

(22) Filed: Aug. 26, 2016

(30) Foreign Application Priority Data

Dec. 23, 2015 (CN) ..... 2015 2 1084823
Dec. 23, 2015 (CN) ..... 2015 2 1084833
Aug. 15, 2016 (CN) ..... 2016 2 0874902

(51) Int. Cl.
*H05B 33/08* (2006.01)

(52) U.S. Cl.
CPC ..... *H05B 33/0845* (2013.01); *H05B 33/0815* (2013.01)

(58) Field of Classification Search
CPC .... H05B 37/02; H05B 33/08; H05B 33/0809; H05B 33/0815; H05B 33/0818; H05B 33/0848; H05B 33/0881; H02M 3/33507; H02M 3/33523; H02M 3/33569
USPC ..... 315/200 R, 209 R, 224–226, 276, 291, 315/297, 307, 308, 312
See application file for complete search history.

(56) References Cited

U.S. PATENT DOCUMENTS

2015/0062975 A1* 3/2015 Shet ..... H02M 3/33523 363/21.12

* cited by examiner

*Primary Examiner* — Jimmy Vu
(74) *Attorney, Agent, or Firm* — Gokalp Bayramoglu

(57) ABSTRACT

The invention discloses and provides a kind of LED phase cut dimming power supply, which comprises AC power supply, phase cut dimmer, LED phase cut dimming power supply and, LED lamp or LED luminaire. The LED phase cut dimming power supply is composed of anti-interference circuit, rectifier circuit I, switching power circuit, rectifier circuit II, dimmer holding current circuit, decompression filter circuit, DC signal amplification circuit, signal conversion circuit, photoelectric coupler, pulse signal amplification circuit, MOS tube, power supply circuit VCC and power supply circuit VDD, which correspond to each and connect with each other adaptively. The input terminal of the anti-interference circuit connects to the output terminal of the phase cut dimmer, and MOS tube or DC TO DC circuit connects to LED lamp or LED luminaire. The invention can be widely used in the field of LED phase cut dimming power supply.

4 Claims, 3 Drawing Sheets

3

KIND OF LED PHASE CUT DIMMING POWER SUPPLY

FIELD OF THE INVENTION

The Invention relates to the field of LED application technology, and more particularly relates to a kind of LED phase cut dimming power supply.

BACKGROUND

With the development and wide application of LED illumination, LED phase cut dimming is more and more widely used since it is convenient for user's installation and wire arrangement and it is easy to reconstruct the illuminating circuits that have been laid in the old building into LED illumination solution with dimming function. However, at present, most of the power supply matching LED phase cut dimming produces the dimming effect by altering the output power through the limitation on the input power of the power supply. Such a method has a certain restriction on the load power. When the load power is lower than 70% of the rated output power of the power supply, the dimming effect will become poorer, and there would be poor compatibility with the phase cut dimmer, narrow dimming range and other shortcomings. Some determines the width and cycle of a pulse by detecting the AC signal phase, and uses the width and cycle of such a pulse to determine the output lighting intensity. Although this method solves the problem of the restriction of load power, generally, it adopts the bleeder circuit, which is composed of resistance and capacitance, to improve the compatibility with the dimmer. However, in practical application, the compatibility is still poor. Moreover, it has such disadvantages as great power loss and heat radiation. When the dimmer with poor compatibility is used for dimming, the AC signals after chopping are random. In addition, the AC signal phase detected with the method of AC phase detection is in disorder, the frequency and pulse width of the pulse signal generated finally keep changing, which is prone to cause serious flickering of light.

To sum up, the LED phase cut dimming power supply in other existing technologies has restriction on load power, poor compatibility with the phase cut dimmer or silicon controlled dimmer, great heat radiation, narrow dimming range, proneness to light flickering, poor dimming effect and other defects.

SUMMARY OF THE INVENTION

The technical problem to be solved by the Invention is to overcome the drawbacks of the prior art and to provide a kind of LED phase cut dimming power supply, which has no restriction on load power and has strong compatibility with the phase cut dimmer or silicon controlled dimmer, wide dimming range and good dimming effect, and is compatible with the front phase cut (lead edge) and the rear phase cut (lagging edge) dimmer.

The technical solution of the Invention is: the Invention comprises AC power supply, phase cut dimmer, LED phase cut dimming power supply and, LED lamp or LED luminaire. The AC power supply connects to the input terminal of the phase cut dimmer; the output terminal of the phase cut dimmer connects to the input terminal of the LED phase cut dimming power supply; the output terminal of the LED phase cut dimming power supply connects to LED lamp or LED luminaire. The LED phase cut dimming power supply is composed of anti-interference circuit, rectifier circuit I, switching power circuit, rectifier circuit II, dimmer holding current circuit, decompression filter circuit, DC signal amplification circuit, signal conversion circuit, photoelectric coupler, pulse signal amplification circuit, MOS tube, power supply circuit VCC and power supply circuit VDD, which correspond to each and connect with each other adaptively. The input terminal of the anti-interference circuit connects to the output terminal of the phase cut dimmer, and MOS tube connects to LED lamp or LED luminaire.

The output terminal of the anti-interference circuit respectively connects to the input terminals of the rectifier circuit I and the rectifier circuit II; the rectifier circuit I connects to the input terminal of the switching power circuit; the output terminal of the switching power circuit respectively connects to the source electrode of MOS tube, power supply circuit VCC and power supply circuit VDD; the output terminal of the rectifier circuit II respectively connects to the dimmer holding current circuit and the decompression filter circuit; the DC signal amplification circuit respectively connects to the decompression filter circuit and signal conversion circuit; the signal conversion circuit connects to the input terminal of the photoelectric coupler the output terminal of the photoelectric coupler connects to the input terminal of the pulse signal amplification circuit; and the output terminal of the pulse signal amplification circuit connects to the grid electrode of MOS tube.

The output terminal of the pulse signal amplification circuit 310 may connect to and control the grid electrode of MOS tube, and then the drain electrode of MOS tube connects LED lamp or LED luminaire; it may also comprise, connect to and control DC TO DC circuit, and then the output terminal of DC TO DC circuit connects to LED lamp or LED luminaire.

All the circuits involved in the LED phase cut dimming power supply may be put in housing and may also be put separately in several housings.

The beneficial effects of the Invention are: the Invention comprises AC power supply, phase cut dimmer, LED phase cut dimming power supply and, LED lamp or LED luminaire. The AC power supply connects to the input terminal of the phase cut dimmer, the output terminal of the phase cut dimmer connects to the input terminal of the LED phase cut dimming power supply, the output terminal of the LED phase cut dimming power supply connects to LED lamp or LED luminaire. The LED phase cut dimming power supply is composed of anti-interference circuit, rectifier circuit I, switching power circuit, rectifier circuit II, dimmer holding current circuit, decompression filter circuit, DC signal amplification circuit, signal conversion circuit, photoelectric coupler, pulse signal amplification circuit, MOS tube, power supply circuit VCC and power supply circuit VDD, which correspond to each and connect with each other adaptively. The input terminal of the anti-interference circuit connects to the output terminal of the phase cut dimmer, and MOS tube connects to LED lamp or LED luminaire. The output terminal of the anti-interference circuit respectively connects to the input terminals of the rectifier circuit I and the rectifier circuit II; the rectifier circuit I connects to the input terminal of the switching power circuit; the output terminal of the switching power circuit respectively connects to the source electrode of MOS tube, power supply circuit VCC and power supply circuit VDD; the output terminal of the rectifier circuit II respectively connects to the dimmer holding current circuit and the decompression filter circuit; the DC signal amplification circuit respectively connects to the decompression filter circuit and signal conversion circuit; the signal conversion circuit connects to the input terminal of the photoelectric coupler; the output terminal of the photoelectric coupler connects to the input terminal of the pulse signal amplification circuit. The output terminal of the pulse signal amplification circuit may connect to the grid electrode of MOS tube, and then the drain electrode of MOS tube connects LED lamp or LED luminaire; it may also comprise, connect to and control DC TO DC circuit, and then the output terminal of DC TO DC circuit connects to LED lamp or LED luminaire. Therefore, the Invention is a kind of LED phase cut dimming power supply, which has no restriction on load power and has strong compatibility with the phase cut dimmer or silicon controlled dimmer, wide dimming range and good dimming effect.

DETAILED DESCRIPTION OF THE EMBODIMENT

Figure 1:
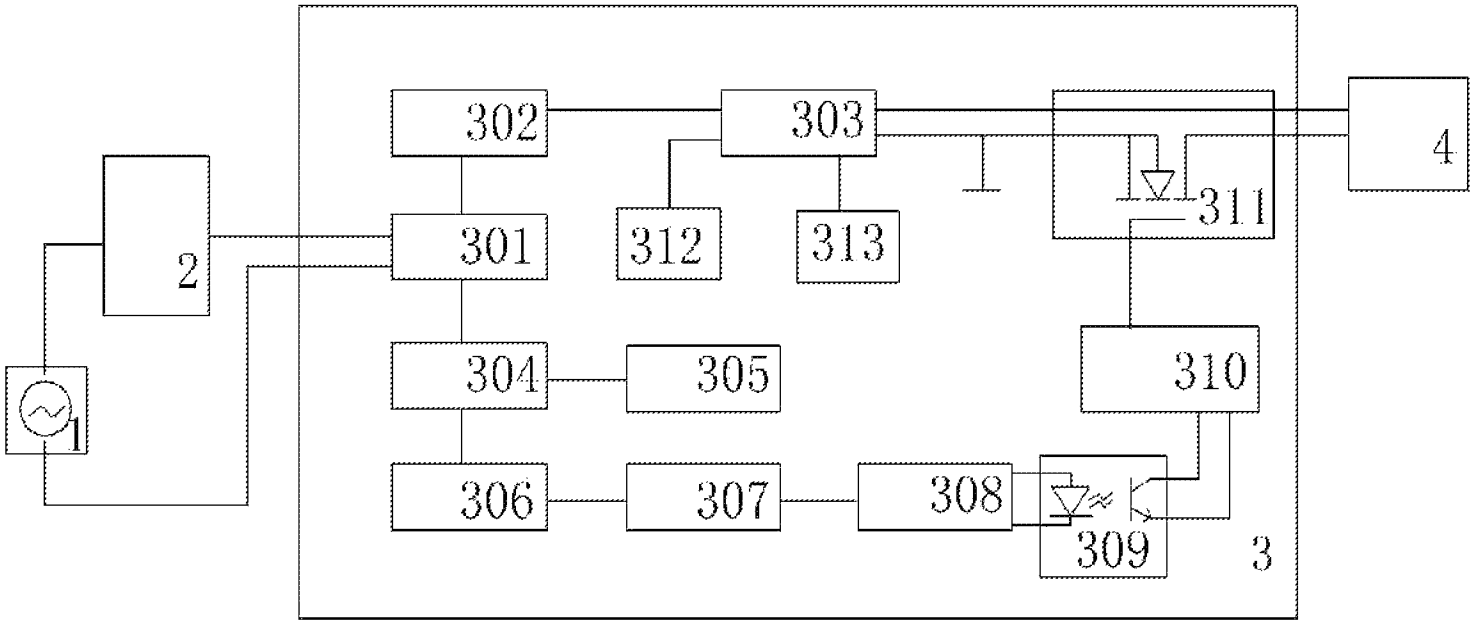
FIG. 1 is a schematic diagram of the Invention.
Figure 2:
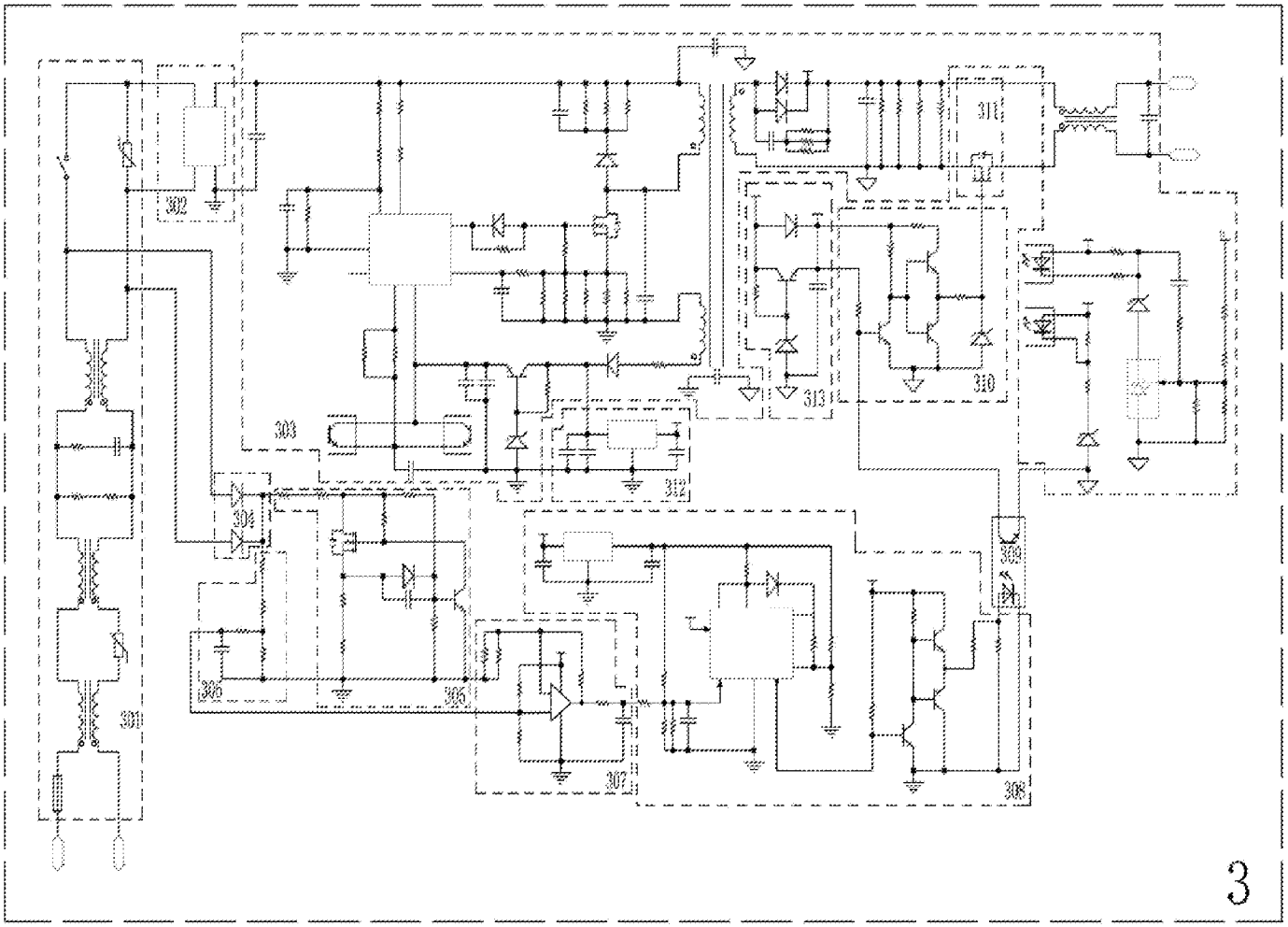
FIG. 2 is a schematic diagram of LED phase cut dimming power supply circuit of the Invention.
Figure 3:
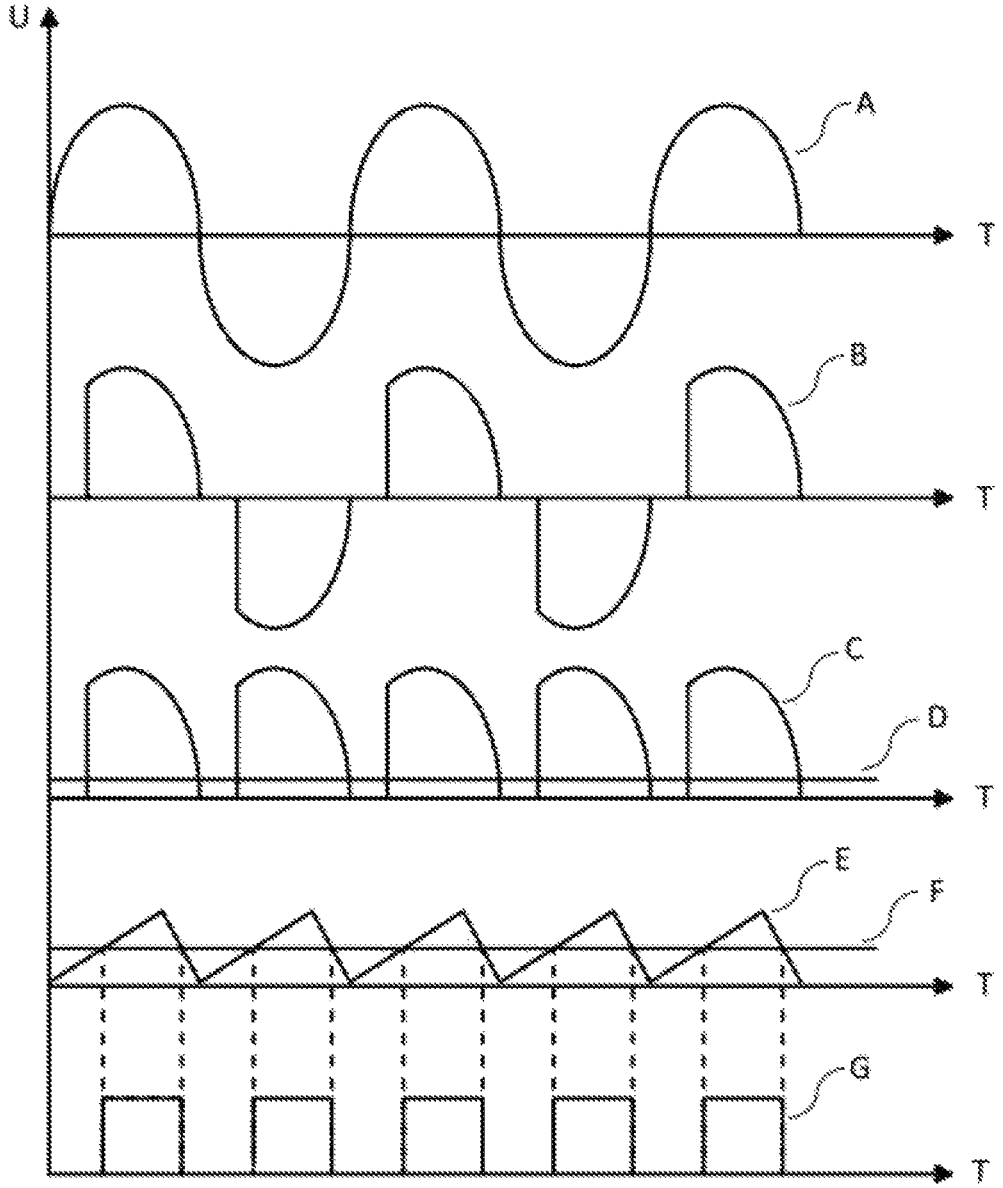
FIG. 3 is a waveform diagram of the Invention.

As shown in FIG. 1 to FIG. 3, the Invention comprises AC power supply 1, phase cut dimmer 2, LED phase cut dimming power supply 3 and, LED lamp or LED luminaire 4. AC power supply I connects to the input terminal of phase cut dimmer 2; the output terminal of phase cut dimmer 2 connects to the input terminal of LED phase cut dimming power supply 3; the output terminal of LED phase cut dimming power supply 3 connects to LED lamp or LED luminaire 4; the LED phase cut dimming power supply 3 is composed of anti-interference circuit 301, rectifier circuit I 302, switching power circuit 303, rectifier circuit II 304, dimmer holding current circuit 305, decompression filter circuit 306, DC signal amplification circuit 307, signal conversion circuit 308, photoelectric coupler 309, pulse signal amplification circuit 310, MOS tube 311, power supply circuit VCC 312 and power supply circuit VDD 313, which correspond to each and connect with each other adaptively. The input terminal of anti-interference circuit 301 connects to the output terminal of phase cut dimmer 2, and MOS tube 311 connects to LED lamp or LED luminaire.

The output terminal of anti-interference circuit 301 respectively connects to the input terminals of rectifier circuit I 302 and rectifier circuit II 304; rectifier circuit I 302 connects to the input terminal of switching power circuit 303; the output terminal of switching power circuit 303 respectively connects to the source electrode of MOS tube 311, power supply circuit VCC 312 and power supply circuit VDD 313; the output terminal of rectifier circuit II 304 respectively connects to dimmer holding current circuit 305 and decompression filter circuit 306; DC signal amplification circuit 307 respectively connects to decompression filter circuit 306 and signal conversion circuit 308; signal conversion circuit 308 connects to the input terminal of photoelectric coupler 309; the output terminal of photoelectric coupler 309 connects to the input terminal of pulse signal amplification circuit 310; and the output terminal of pulse signal amplification circuit 310 connects to the grid electrode of MOS tube 311.

Output terminal of pulse signal amplification circuit 310 may connect to and control the grid electrode of MOS tube 311, and then the drain electrode of MOS tube 311 connects LED lamp or LED luminaire 4; output terminal of pulse signal amplification circuit 310 may also comprise, connect to and control DC TO DC circuit, and then the output terminal of DC TO DC circuit connects to LED lamp or LED luminaire 4.

All the circuits involved in the LED phase cut dimming power supply may be put in housing and may also be put separately in several housings.

In the Embodiment, after chopping in phase cut dimmer 2, AC power supply 1 is input to the input terminal of LED phase cut dimming power supply 3, and enters switching power circuit 303 through anti-interference circuit 301 and then the rectifier circuit I 302. By energy conversion, the constant-voltage or constant-current DC converted from switching power circuit 303 passes through the LED lamp or LED luminaire 4 matching with supply of MOS tube 311, and simultaneously passes through AC after chopping in phase cut dimmer 2, and then passes through anti-interference circuit 301 as well as the other rectifier circuit II 304, and enters to dimmer holding current circuit 305 and decompression filter circuit 306. Dimmer holding current circuit 305 provides a stable holding current for phase cut dimmer 2, to ensure the normal operation of phase cut dimmer 2 and improve the compatibility of LED phase cut dimming power supply 3 and phase cut dimmer 2. Decompression filter circuit 306 converts the input AC into a low-level DC signal by resistance divider and large capacity of electrolytic capacitor filter. The electrical level of such DC signal is directly related to the average or effective voltage of the AC input to LED phase cut dimming power supply 3, that is, an alteration of the average or effective AC voltage can change the voltage of the DC signal converted in decompression filter circuit 306. Therefore, the voltage of the DC signal generated in decompression filter circuit 306 can be changed by altering the chopped AC depth through phase cut dimmer 2. Since decompression filter circuit 306 connects to DC signal amplification circuit 307, such a DC signal will be input to DC signal amplification circuit 307, and generate a DC signal amplified according to a certain proportion. Of course, such an amplified DC signal also changes with the change of the AC input to LED phase cut dimming power supply 3. In addition, since DC signal amplification circuit 307 connects to signal conversion circuit 308, the amplified DC signal will be input to signal conversion circuit 308. Generally, signal conversion circuit 308 is composed of a signal comparator and a sawtooth wave generator circuit. Signal conversion circuit 308 respectively inputs the input and amplified DC signal and the sawtooth signal generated in the sawtooth wave generator circuit into the signal comparator. And by comparing the two signals with the signal comparator, it will generate a pulse signal with the same frequency as the sawtooth wave. The pulse width or duty cycle of such a pulse signal is determined by the DC signal input to the signal conversion circuit. Signal conversion circuit 308 may also be achieved with a single-chip microcomputer. It can output a pulse signal corresponding to the electrical level of DC signal by collecting DC signal electrical level and processing it through an internal program. And the pulse width or duty cycle of such a pulse signal is also determined by the DC signal input to signal conversion circuit 308. The frequency of the pulse signal may be set by setting the frequency of the sawtooth signal generated in the sawtooth wave generator circuit or through the internal program of the single-chip microcomputer. The frequency is generally set above 200 Hz. Sometimes, there will be a phase-inverter circuit in signal conversion circuit 308 to invert the pulse signal and then input it into the next stage of circuit. The pulse signal generated in the signal conversion circuit 308 is input to photoelectric coupler 309 and transmitted to pulse signal amplification circuit 310. After being amplified in pulse signal amplification circuit 310, the pulse signal controls the on and off of MOS tube 311 at the output terminal of LED phase cut dimming power supply 3, thereby adjusting the lighting intensity of LED lamp or LED luminaire 4. Wherein, the switching frequency of MOS tube 311 is the same as the frequency of the pulse signal. The amplified phase signal may also be used to control the operating state of the DC TO DC power supply circuit, thereby altering the electrical level of the output constant-voltage or constant-current DC, and correspondingly changing the lighting intensity of LED lamp or LED luminaire 4.

In the Embodiment, the principle is further illustrated by combining with the waveform diagram shown in FIG. 3. In the diagram, X axis refers to time, while Y axis refers to voltage. The waveform of main supply 1, i.e. alternating current is as shown in A. It will become Waveform B as shown after chopping in phase cut dimmer 2 and be input into anti-interference circuit 301 in LED phase cut dimming power supply 3. And then a part of it passes through rectifier circuit I 302 and enter switching power circuit 303 for energy conversion. The other part enters the rectifier circuit II 304 and its voltage waveform is as shown in Waveform C. Then such a waveform voltage is carried out with decompression and filter in the decompression filter circuit 306 and becomes a smoothing DC signal of Waveform D as shown in the diagram. Such a DC signal is input to the signal conversion circuit 308 after it is amplified in DC signal amplification circuit 307, and then it is compared with the sawtooth signal generated in the sawtooth wave generator circuit in the signal conversion circuit 308, as shown in Waveform E in the diagram. From the diagram, it can be seen that, after the comparison between the sawtooth signal as shown in Waveform E and the amplified DC signal as Waveform F, signal conversion circuit 308 will output a pulse signal as shown in Waveform G. Of course, in other signal conversion circuits with the use of single-chip microcomputer, the single-chip microcomputer can output the pulse signal with the corresponding pulse width as Waveform G by collecting the amplified DC signal as Waveform F and processing it with its internal program. From FIG. 3, it can also be seen that the electrical level of the amplified DC signal determines the pulse width of the output pulse signal. Generally, the pulse signal converted in signal conversion circuit 308 will also be inverted in the phase-inverter circuit in it and output to photoelectric coupler 309 and pulse signal amplification circuit 310 to control MOS tube 311 or the DC TO DC power supply circuit, and finally control the output volume of LED phase cut dimming power supply 3, so as to control the lighting intensity of LED lamp or LED luminaire 4.

The Invention can be widely used in the field of LED phase cut dimming power supply.

The invention claimed is:

1. A kind of LED phase cut dimming power supply, comprises a AC power supply, a phase cut dimmer, a LED phase cut dimming power supply and, a LED lamp or a LED luminaire, wherein the AC power supply connects to the input terminal of the phase cut dimmer; the output terminal of the phase cut dimmer connects to the input terminal of the LED phase cut dimming power supply; the output terminal of the LED phase cut dimming power supply connects to LED lamp or LED luminaire; the LED phase cut dimming power supply is composed of an anti-interference circuit, a rectifier circuit I, a switching power circuit, a rectifier circuit II, a dimmer holding current circuit, a decompression filter circuit, a DC signal amplification circuit, a signal conversion circuit, a photoelectric coupler, a pulse signal amplification circuit, a MOS tube, a power supply circuit VCC and a power supply circuit VDD, which correspond to each and connect with each other adaptively; the input terminal of the anti-interference circuit connects to the output terminal of the phase cut dimmer, and the MOS tube connects to the LED lamp or the LED luminaire.

2. The kind of LED phase cut dimming power supply according to claim 1, wherein the output terminal of the anti-interference circuit respectively connects to the input terminals of the rectifier circuit I and the rectifier circuit II; the rectifier circuit I connects to the input terminal of the switching power circuit; the output terminal of the switching power circuit respectively connects to the source electrode of MOS tube, power supply circuit VCC and power supply circuit VDD; the output terminal of the rectifier circuit II respectively connects to the dimmer holding current circuit and the decompression filter circuit; the DC signal amplification circuit respectively connects to the decompression filter circuit and signal conversion circuit; the signal conversion circuit connects to the input terminal of the photoelectric coupler; the output terminal of the photoelectric coupler connects to the input terminal of the pulse signal amplification circuit; and the output terminal of the pulse signal amplification circuit connects to the grid electrode of the MOS tube.

3. The kind of LED phase cut dimming power supply according to claim 2, wherein the output terminal of the pulse signal amplification circuit may connect to and control the grid electrode of MOS tube, and then the drain electrode of MOS tube connects to the LED lamp or the LED luminaire; the output terminal of the pulse signal amplification circuit may also comprise, connect to and control DC TO DC circuit, and then the output terminal of DC TO DC circuit connects to the LED lamp or the LED luminaire.

4. The kind of LED phase cut dimming power supply according to claim 1, wherein all the circuits involved in the LED phase cut dimming power supply may be put in one housing and may also be put separately in several housings.

* * * * *